United States Patent [19]

Brimm et al.

[11] Patent Number: 4,779,848

[45] Date of Patent: Oct. 25, 1988

[54] COOLING MUFF USED IN THERMAL PROCESSING METHOD

[75] Inventors: Daniel J. Brimm; James R. Gramse, both of San Diego County, Calif.

[73] Assignee: Chem-Tronics, Inc., El Cajon, Calif.

[21] Appl. No.: 821,898

[22] Filed: Jan. 23, 1986

Related U.S. Application Data

[60] Division of Ser. No. 740,552, Jun. 3, 1985, abandoned, which is a continuation of Ser. No. 260,748, May 5, 1981, abandoned.

[51] Int. Cl.[4] ..... C21D 1/00

[52] U.S. Cl. ..... 266/259; 266/287; 432/253

[58] Field of Search ..... 266/259, 287; 148/149; 432/253, 254.1

[56] References Cited

U.S. PATENT DOCUMENTS

| | | | |
|---|---|---|---|
| 1,418,985 | 6/1922 | Stock | 266/260 |
| 2,294,413 | 4/1939 | Marshall | 239/567 |
| 2,856,803 | 6/1955 | Fredricksson et al. | 72/201 |
| 3,193,269 | 11/1962 | Hammon | 432/226 |
| 3,430,686 | 10/1967 | Parkison et al. | 165/1 |
| 3,559,447 | 9/1968 | Bogart | 72/342 |
| 3,592,703 | 7/1971 | Dehn et al. | 148/149 |
| 3,593,409 | 7/1971 | Silverstein | 29/488 |
| 3,704,871 | 12/1972 | Paulson | 148/149 |
| 4,044,590 | 8/1977 | Strahm | 72/342 |
| 4,122,700 | 10/1978 | Granzow | 72/342 |
| 4,188,811 | 2/1980 | Brimm | 72/63 |
| 4,291,566 | 9/1981 | Dinsdale | 72/342 |

*Primary Examiner*—Christopher W. Brody

*Attorney, Agent, or Firm*—Hughes, Cassidy, & Multer

[57] ABSTRACT

Methods of, and equipment for, protecting selected parts of a component against overheating while the component is being thermally treated.

13 Claims, 2 Drawing Sheets

COOLING MUFF USED IN THERMAL PROCESSING METHOD

RELATION TO OTHER APPLICATIONS

This application is a division of application No. 740,552 now abandoned. Application No. 740,552 is a continuation of application No. 260,748 filed May 5, 1981 (now abandoned).

TECHNICAL FIELD OF THE INVENTION

In one aspect this invention relates to methods for heat treating metallic workpieces and, more particularly, to novel improved methods of that character which allow selected parts of the workpiece to be kept at a relatively low temperature while the workpiece is heated overall to a much higher temperature, thereby insulating those parts of the workpiece from changes effected in the rest of the workpiece by heating it.

In a second aspect our invention relates to a novel cooling muff which can be employed to keep a selected part of the workpiece at the relatively low temperature and to thereby protect it from the changes effected in the rest of the workpiece at the elevated temperature.

One particularly important application of our invention is in the refurbishing of gas turbine engine fan blades, and the principles of the invention will consequently be developed primarily by reference to that application. The reader should understand, however, that this is being done primarily for the sake of convenience and is not intended to limit the scope of the invention as defined in the appended claims.

Gas turbine engine fan blades of the type with which we are particularly concerned are of that conventional construction having shrouds intermediate their roots and tips. The shrouds of adjacent blades rub against each other as the wheel in which they are incorporated rotates. These rubbing surfaces are, consequently, typically coated or faced with a hard, wear resistant material to extend the service life of the blades.

Typically, gas turbine engine fan blades of the type described above are fabricated of a titanium alloy. One requirement of jet engine developers and manufacturers is that fan blades of this character be shot peened or similarly treated to stress the surfaces of the blade. This reduces the susceptibility of the blades to cracking, which is highly desirable, if not required, for obvious reasons.

It is well known that gas turbine engine blades may become damaged or distorted by impact from foreign objects, load stresses, and high temperatures. Until a few years ago, such blades were discarded because blade distortion reduces engine efficiency and/or causes erratic operation.

However, because of high blade replacement costs, such blades are now being repaired and refurbished rather than being discarded as has been the practice in the past.

One state-of-the-art technique for refurbishing gas turbine fan blades is described in U.S. Pat. No. 4,181,811 which was issued Feb. 19, 1980, to Daniel J. Brimm for METAL FORMING METHODS. That patent is assigned to the assignee of this application and is hereby incorporated therein by reference.

The blade refurbishing technique to which U.S. Pat. No. 4,188,811 is devoted, and other blade refurbishing techniques as well, require that the blade being processed be heated to a temperature which is sufficiently high to anneal or relieve the surface stresses required in the refurbished blade.

For the most part, this does not pose a significant technological or economic problem because the blade can be shot peened to restore the requisite surface stresses after it has been refurbished. This is not true as far as those surfaces which are coated with the hard, wear resistant facing are concerned. In that case, the facing must be removed; and, after the blade has been refurbished and shot peened or otherwise again surface stressed, the coating must be replaced. This is a rather specialized task requiring facilities which are not readily available; and the time and cost involved in treating these rubbing surfaces of the shroud are therefore not insignificant.

SUMMARY OF THE INVENTION

We have since discovered that the problem posed in the preceding paragraphs can be avoided during the blade refurbishing process. This is done by keeping the shrouds of the blades at a temperature low enough to prevent the stresses from being relieved in their hard faced surfaces while the blades are overall heated to the much higher, stress-relieving temperature needed to reshape and/or otherwise refurbish them. As a consequence, it is not necessary to remove and replace the hard, wear resistant coating; and the time consumed and expense involved in doing so are consequently avoided. Furthermore, the reliance on specialized, outside suppliers to recoat the rubbing surfaces of the refurbished blades is eliminated.

Various techniques can be employed to maintain the shrouds of the blades being processed at a sufficiently low temperature to insulate them against stress relief. One device that has proved particularly effective for this purpose, and which is also part of our invention, is a novel cooling muff that is configured to be compatible with, and can be slipped onto, a selected part of the workpiece being processed such as the shroud of a turbine engine fan blade. The muff is composed of a rigid casing housing flexible components configured to match the external surface configuration of that protected part of the workpiece. There are internal spaces or passages between these flexible components and the casing components in which they are housed. After the muff has been slipped in place, a fluid is circulated under pressure through those spaces. This deflects the flexible internal components against the associated workpiece surfaces, clamping the muff in place.

This same fluid, typically air, is also employed to effect a transfer of heat away from the parts of the workpiece in which the maintenance of a relatively low temperature is desired. The transfer of heat from those parts of the workpiece to the heat transfer fluid is, furthermore, preferably promoted by stuffing the internal spaces in the muff with a highly conductive, metal wool, for example, to generate turbulence in the heat transfer fluid.

The maintenance of the protected part of the workpiece at the wanted, lower temperature is also preferably promoted by surrounding the muff with an appropriate, high temperature resistant insulation.

The workpiece may be heated in an annealing furnace, for example. Alternatively, and especially where shaping of the blade to its original, or a different, contour is involved, the thermal processing can advantageously be carried out in a retort of the character described in the above-identified U.S. Pat. No. 4,188,811. In this case, a die in the retort provides a surface against which the workpiece can be formed; and the muff is seated in an appropriate cavity in that die.

OBJECTS OF THE INVENTION

From the foregoing it will be apparent to the reader that one important and primary object of our invention resides in the provision of novel, improved methods for thermally processing workpieces fabricated of metallic materials.

Another, equally important and primary object of our invention resides in the provision of certain novel equipment for carrying out the thermal processes we have invented.

Yet another, also equally important and primary, object of the present invention is the provision of methods and equipment as identified in the preceding objects which allow the workpiece to be heated overall to an elevated temperature while maintaining one or more selected portions of the workpiece at a second, lower temperature to thereby insulate the selected workpiece portion(s) against unwanted changes they would undergo if heated to the elevated temperature.

Another important, but more specific, object of our invention resides in the provision of methods and equipment as described in the preceding objects which can be employed to advantage in the repair and refurbishing of gas turbine engine fan blades.

THE PRIOR ART

Techniques for thermally processing metallic workpieces which resemble ours to the extent that localized areas of the workpiece are cooled or otherwise protected against overheating are described in U.S. Pat. Nos. 2,294,413 issued Sept. 1, 1942, to Marshall; 3,193,269 issued July 6, 1965, to Hammon; 3,430,686 issued Mar. 4, 1969, to Parkinson et al; 3,559,447 issued Feb. 2, 1971, to Bogart; 3,593,409 issued July 20, 1971, to Silverstein; 3,704,871 issued Dec. 5, 1972, to Paulson; 4,044,590 issued Aug. 30, 1977, to Strahm; and 4,122,700 issued Oct. 31, 1978, to Granzow. In no case, however, does the patented technique or equipment more than superficially resemble that which we have invented.

Marshall, Hammon, and Paulson, for example, are concerned with surface hardening processes, not with heating a workpiece overall to an elevated temperature while maintaining one or more parts of the workpiece at a lower temperature. Parkinson et al, Silverstein, and Strahm disclose various shields for inhibiting the spread of heat, not techniques or equipment for effecting localized cooling; and Bogart and Granzow are concerned only with localized temperature control by use of dies and/or mating punches.

Certain important objects of our invention have been identified above. Other important objects and features and additional advantages of our invention will be apparent to the reader from the foregoing and the appended claims and as the ensuing detailed description and discussion proceeds in conjunction with the accompanying drawing.

DETAILED DESCRIPTION OF THE INVENTION

Figure 1:
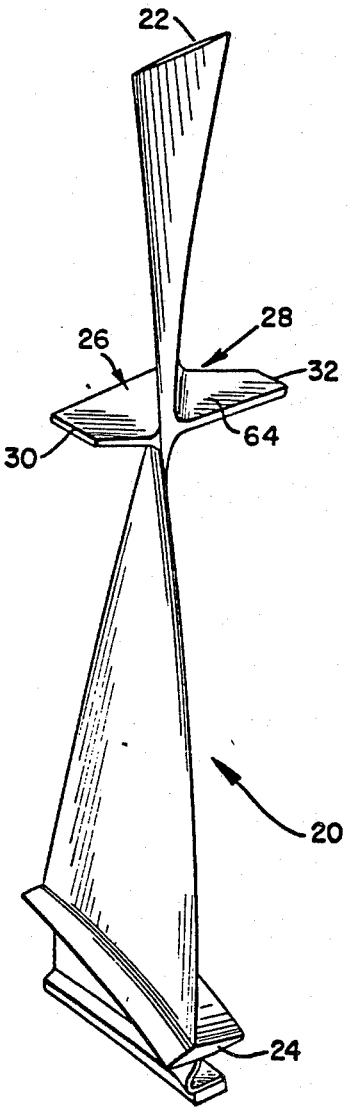
FIG. 1 is a pictorial view of a gas turbine engine fan blade; that blade has shrouds with stressed surfaces coated with a hard, wear resistant material, and those surfaces can be protected or insulated against stress relief in accord with the principles of the present invention when the blade is, overall, heated to a temperature sufficiently high to cause stress relief.

Referring now to the drawing, it was pointed out above that the principles of the present invention can be employed to particular advantage in the repairing and refurbishing of gas turbine engine fan blades. One blade of that character is illustrated in FIG. 1 and identified by reference character 20.

Blade 20 has the usual tip 22, root 24, and shrouds 26 and 28. The surfaces 30 and 32 of shrouds 26 and 28 are coated with a hard, wear resistant material such as Union Carbine's LW-1 or LW-LN40, both of which consist of a tungsten carbide in a cobalt binder. These coatings inhibit wear of the shrouds as surfaces 30 and 32 rub against the corresponding surfaces of the shrouds of those adjacent blades (not shown) in the wheel in which blade 20 is assembled.

Invariably, it is required that all surfaces of a blade such as that identified by reference character 20, including the surfaces 30 and 32 of shrouds 26 and 28, be shot peened or similarly treated to induce surface stresses in them and thereby reduce crack sensitivity. In repairing or refurbishing such blades, they must typically be heated to a temperature which is sufficiently high that the surface stresses are relieved, thereby requiring that the refurbished blade be shot peened or similarly treated to regenerate the surface stresses before the blade is returned to service.

This requires that the wear resistant coating be removed from shroud surfaces 30 and 32 and replaced after those surfaces have been shot peened. That is undesirable, from the viewpoints of cost and time, because specialized equipment such as Union Carbide's detonation gun is needed to apply coatings of the type with which we are concerned. Therefore, the refurbished and shot peened blades must be shipped to the foregoing company, or to another owner of suitable, specialized equipment, to replace the wear resistant coating.

We have now invented a novel method of handling blades such as 20 (and other workpieces as well) which makes this whole process of removing the wear resistant coating from the shroud surfaces and later replacing those coatings unnecessary. In particular, it is normally not necessary to deal with shrouds 26 and 28 in repairing or refurbishing a blade of the character illustrated in FIG. 1. And we have invented a novel technique for keeping the shrouds (or localized parts of other workpieces) at a sufficiently low temperature to inhibit the relief of stresses in those shrouds, and particularly in coated surfaces 30 and 32, while the blade is overall heated to a temperature at which they would otherwise disappear. This permits the blade to be shaped, reshaped, or otherwise remanufactured without removing and replacing the coating.

Figure 2:
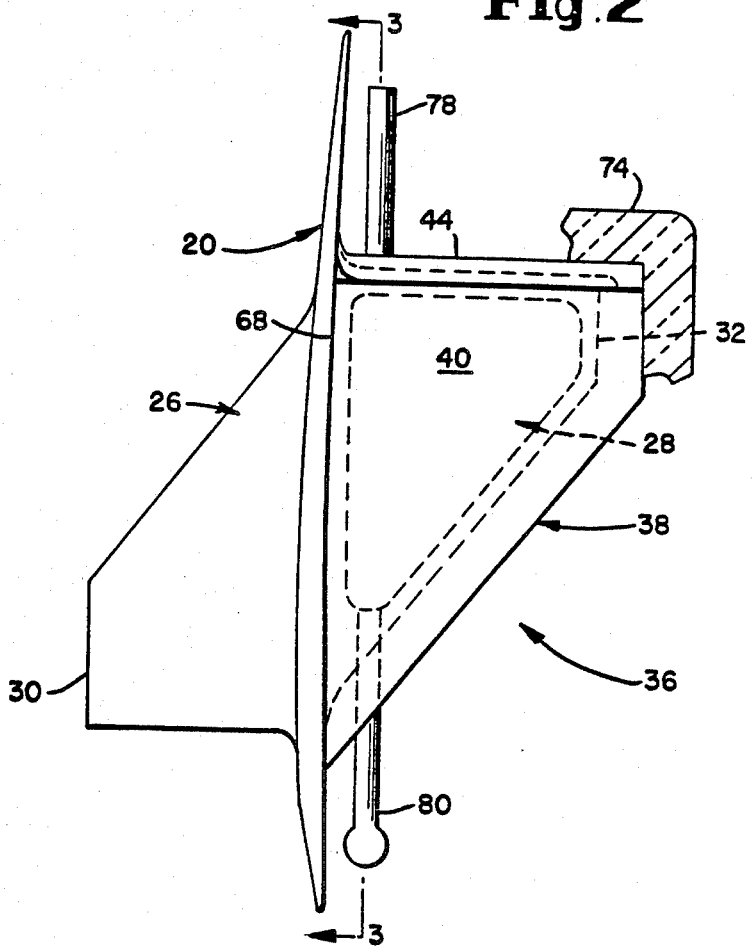
FIG. 2 is an end view of the turbine blade with a cooling muff in accord with the principles of the present invention installed on a shroud thereof to insulate that shroud against stress relief when the blade is heated to a stress relieving temperature.
Figure 3:
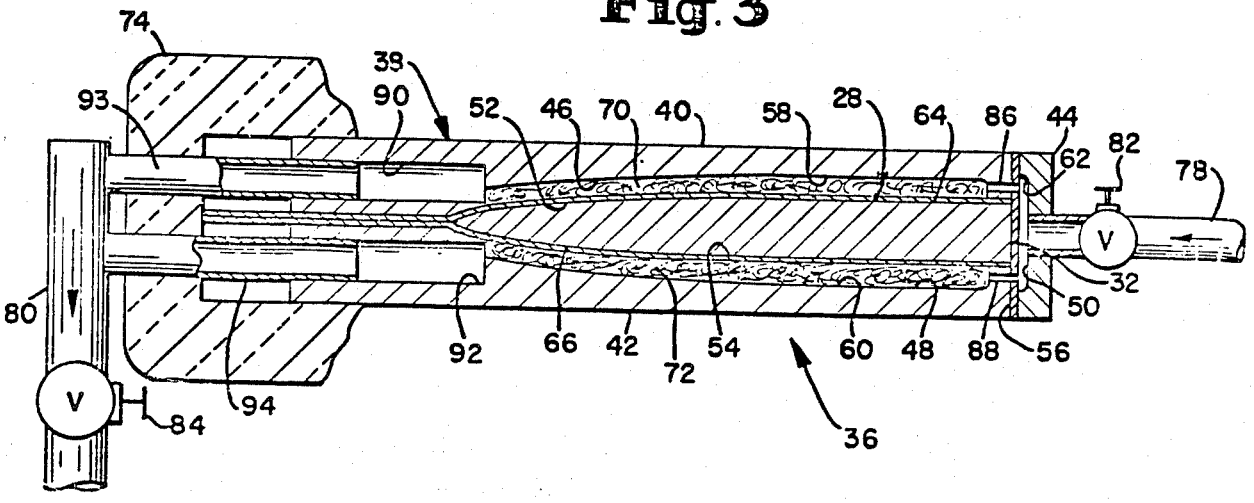
FIG. 3 is a section through the cooling muff taken substantially along line 3—3 of FIG. 2.

In the exemplary embodiment of our invention illustrated in the drawing, this novel result is achieved by use of a cooling muff 36 (see FIGS. 2 and 3).

Referring now specifically to those figures, cooling muff 36 is composed in part of a rigid casing 38 made up of two trapezoidal side plates 40 and 42 and a rectangular end plate 44. Cavities 46, 48, and 50 opening onto the inner or internal surfaces thereof are formed in these three casing components.

As best shown in FIG. 3, thin, flexible foils 52, 54, and 56 are brazed or otherwise sealed to the inner surfaces of the rigid casing members 40, 42, and 44. This forms a passage 58 between casing member 40 and foil or flexible component 52, a passage 60 between foil 54 and casing member 42, and a passage 62 between foil 56 and casing member 44.

As is apparent from FIGS. 2 and 3, casing 38 and the flexible components 52, 54, and 56 housed therein are contoured to match the upper and lower surfaces 64 and 66 of shroud 28 and the outer, coated surface 32 of that shroud. The cooling muff furthermore has an open end 68 which allows it to be slipped onto the shroud to the location shown in FIG. 2. A similar muff (not shown) is employed to similarly protect the second shroud 26 during the thermal processing of blade 20.

Once cooling muff 36 has been installed as shown in FIGS. 2 and 3, it is clamped to the shroud 28 of blade 20 by circulating air (or any other appropriate fluid) under pressure through the passages 58, 60, and 62 in the cooling muff. This forces the flexible components 52, 54, and 56 housed in cooling muff casing 36 against the upper, lower, and outer surfaces 64, 66, and 32 of shroud 28, clamping the muff securely to it.

This same cooling fluid is also employed to conduct heat away from shroud 28, thereby inhibiting the relief of the stresses theretofore generated in the upper, lower, and end surfaces 64, 66, and 32 of the shroud.

To increase the heat transfer efficiency of the air or other fluid circulated through cooling muff 36, turbulence is preferably generated in the heat transfer fluid. This can be accomplished by packing passages 58 and 60 with a high conductivity material such as aluminum wool (see reference characters 70 and 72 in FIG. 3).

The efficiency of cooling muff 36 is furthermore preferably promoted by surrounding its casing 38 with an appropriate insulation such as Thermasil 120 castable glass rock. This insulation, shown only in part in FIGS. 2 and 3, is identified by reference character 74.

Referring now most specifically to FIG. 3, the air or other fluid employed to clamp muff 36 to shroud 28 and to conduct heat therefrom is supplied to the muff through a supply pipe 78 and discharged from the muff into a discharge pipe 80. The rate-of-flow of the fluid through the muff and the pressure drop thereacross are controlled by a valve 82 in supply pipe 78 and a valve 84 in discharge pipe 80.

Referring still to FIG. 3, fluid supply pipe 78 communicates with the cooling passage 62 between end plate 44 and flexible foil 56. This passage is in turn connected through flow passages 86 and 88 to the cooling passages 58 and 60 between the casing members 40 and 42 and the flexible foils sealed to those members.

After circulating through those passages, the fluid flows into plenums 90 and 92 in casing side members 40 and 42 and from them through branch discharge pipes 93 and 94 into main fluid discharge pipe 80.

As indicated above, the clamping pressure and degree to which shroud 28 is cooled can be controlled by the adjustment of inlet and outlet valves 82 and 84. Particularly, these parameters can be controlled either by varying the inlet pressure and rate of fluid flow or by holding the foregoing constant and adjusting the rate-of-flow through discharge pipe 80 by valve 84.

In both cases, air at inlet pressures varying from 25 to 100 psi has proven effective. Specifically, production tests have demonstrated that, thus operated, the cooling muff identified by reference character 36 in the drawing is capable of maintaining the shrouds of a titanium-based gas turbine engine fan blade at temperatures below 500° F. for periods up to 2 hours while the blade is heated overall at a temperature of 1200° F. for that period. Inspection of the shrouds after such tests furnish no evidence of reduction in the shroud's surface stresses and no change in the hard, wear resistant coating on surface 32.

Figure 4:
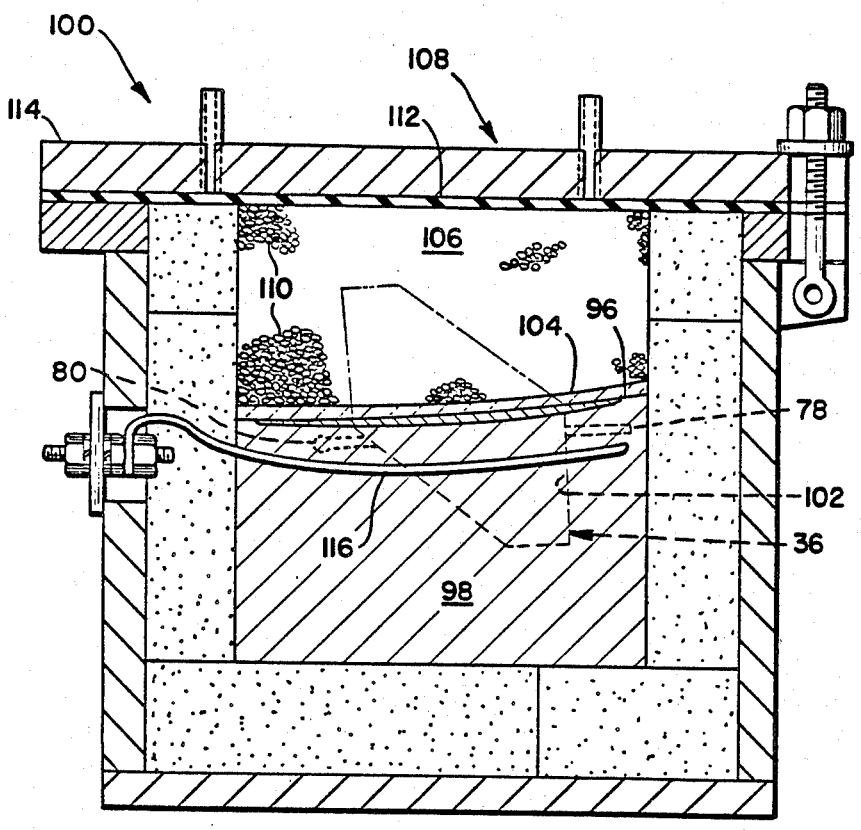
FIG. 4 is a section through a retort in which a blade or other workpiece can be heated and shaped or reshaped while one or more workpiece portions are protected in accord with the principles of the present invention against changes caused elsewhere in the workpiece by heating it to an elevated temperature.

With muff 36 installed, blade 20 can be heated to the 1200° F. or other appropriate rework temperature in an annealing or other appropriate furnace. Alternatively, and especially when the refurbishing or remanufacturing process involves shaping of the blade, the heating and shaping of the blade can advantageously be carried out in a retort of the character disclosed in U.S. Pat. No. 4,188,811 which was above incorporated herein by reference. In the latter case, and referring specifically to FIG. 4, the blade to be refurbished is first cleaned and coated as described in U.S. Pat. No. 4,188,811; and, after the muffs are installed, the blade is placed on the face 96 of a die 98 housed in the retort (identified by reference character 100) and cut out to accommodate cooling muff 36.

Next, metal shims (not shown) are installed to support root 24 of the blade and prevent movement. They also locate the shroud 28 and muff 36 in the die cavity 102 provided to accommodate the latter.

After the blade and muff have been installed and shimmed in place, the blade is covered with a sheet 104 of a heat resistant or refractory material such as Refrasil, asbestos, or the like. The cavity 106 in the casing 108 of retort 100 above sheet 104 is then filled with a compliant, heat resistant, pressure transferring medium 110 such as pieces of Refrasil or vermiculite, strips of asbestos, or heat resistant glass beads.

After cavity 106 is filled, a sheet 112 of a heat resistant rubber or silicone is placed over the top of the compliant material. That sheet provides a vacuum or pressure type seal when the lid 114 is closed and clamped in place; it also serves as a pressure transmitting member.

After the blade is installed in the retort and the latter sealed, the circulation of the fluid through the muff is initiated to clamp the muff to the blade and to keep shroud 28 and particularly its surface 32 from becoming overheated as the rest of the blade is heated to the forming temperature. Then, two or three pounds of air pressure is applied to the top of the flexible sheet seal 112; and heating elements 116 in die 98 are energized to heat the workpiece.

The pressure applied to the top of flexible seal 112 is increased as blade 20 reaches the forming temperature. Up to 120 psi has been used.

The heat and pressure transmitted to blade 20 by the compliant material 110 in the retort cavity 106 cause the metal of which that blade is fabricated to flow plastically at a stress below its yield strength. Such plastic flow (or creep forming) permits the blade to match and retain the shape of die face 96.

Once reshaping has been accomplished, the heating elements are deenergized, the blade cooled, the muffs removed, and the blade cleaned and inspected to complete the refurbishing process.

Details of the process just described are set forth in U.S. Pat. No. 4,188,811 to which the reader may refer, if desired.

Our invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by United States Letters Patent is:

1. A cooling muff for insulating a selected portion of a metallic workpiece being heated to an elevated temperature against changes effected in the rest of the workpiece by heating it to said temperature, said muff comprising a rigid casing; flexible components in and spaced from said casing, said components being contoured to match the external configuration of said selected portion of the workpiece; and means via which a fluid can be circulated under pressure through the internal spaces in said muff between said casing and said components to thereby bias said flexible components against said selected portion of said workpiece and clamp said muff thereto.

2. A cooling muff as defined in claim 1 wherein said casing and the components housed therein are fabricated from a stainless steel.

3. A cooling muff as defined in claim 1 which has an opening to the interior thereof that permits said muff to be slipped onto said selected portion of said workpiece.

4. A cooling muff as defined in claim 1 in which each of the components housed in said casing is sealed to a corresponding component of said casing with an internal space as aforesaid therebetween, each said casing component having a cavity therein which cooperates with the component sealed thereto to form an internal space as aforesaid.

5. The combination of a cooling muff as defined in claim 1 and means on the upstream or downstream sides of said muff or both for controlling the flow of fluid through the internal spaces between the casing of said muff and the components housed therein.

6. A cooling muff for insulating a selected portion of a metallic workpiece being heated to an elevated temperature against changes effected in the rest of the workpiece by heating it to said temperature, said muff comprising a casing; components housed in and spaced from said casing which can be so displaced by the application of fluid pressure thereto as to bias them against and conform them to the external configuration of said selected workpiece portion; and means for circulating a heat transfer fluid through the internal spaces between said casing and said components to effect a transfer of heat from said selected portion of said workpiece and thereby keep it at a temperature below said elevated temperature.

7. A cooling muff as defined in claim 6 which includes thermal insulation surrounding said casing.

8. A cooling muff as defined in claim 6 which has means in the spaces between said casing and the components housed therein for generating turbulence in the heat transfer fluid and thereby promoting the transfer of heat from said selected portion of said workpiece to said fluid.

9. A cooling muff as defined in claim 8 wherein the material in the spaces between the casing and the components housed therein is a metal wool with high conductivity.

10. A cooling muff as defined in claim 6 wherein said casing and the components housed therein are fabricated from a stainless steel.

11. A cooling muff as defined in claim 6 which has an opening to the interior thereof that permits said muff to be slipped onto said selected portion of said workpiece.

12. A cooling muff as defined in claim 6 in which each of the components housed in said casing in sealed to a corresponding component of said casing with an internal space as aforesaid therebetween, each said casing component having a cavity therein which cooperates with the component sealed thereto to form an internal space as aforesaid.

13. The combination of a cooling muff as defined in claim 6 and means on the upstream or downstream sides of said muff or both for controlling the flow of fluid through the internal spaces between the casing of said muff and the components housed therein.

* * * * *